US007669253B2

(12) United States Patent
Lin

(10) Patent No.: US 7,669,253 B2
(45) Date of Patent: Mar. 2, 2010

(54) POSITIONING STRUCTURE FOR THE MALE REPRODUCTIVE ORGAN

(76) Inventor: Che-Wen Lin, P.O. Box No. 6-57, Junghe, Taipei 235 (TW)

( * ) Notice: Subject to any disclaimer, the term of this patent is extended or adjusted under 35 U.S.C. 154(b) by 153 days.

(21) Appl. No.: 12/007,597

(22) Filed: Jan. 14, 2008

(65) Prior Publication Data

US 2009/0178183 A1 Jul. 16, 2009

(51) Int. Cl.
*A41B 9/02* (2006.01)

(52) U.S. Cl. ..... 2/405; 2/400; 2/401; 2/402; 2/403; 2/404; 602/67; 602/68; 602/69; 602/70; 602/71

(58) Field of Classification Search ..... 2/73, 2/78.1, 78.2, 78.3, 78.4, 113, 400, 401, 402, 2/403, 404, 405, 227, 228, 236, 237, 238; 602/67, 68, 69, 70, 71, 72
See application file for complete search history.

(56) References Cited

U.S. PATENT DOCUMENTS 1,477,187 A * 12/1923 Rayne ..... 602/71
4,414,971 A * 11/1983 Chung ..... 602/67
5,870,779 A * 2/1999 Heron ..... 2/403
6,295,651 B1 * 10/2001 Kang ..... 2/403
2008/0052807 A1 * 3/2008 Lai ..... 2/405

* cited by examiner

*Primary Examiner*—Gary L Welch
*Assistant Examiner*—Alissa J Tompkins

(57) ABSTRACT

A positioning structure for the male reproductive organ, and more particularly provides a positioning structure which contributes to the hygiene, health and comfort of the male reproductive organ, and mainly includes a main body, a spacing portion, a holding portion and a positioning portion, wherein the main body further comprises at least one lower retaining portion and a waistband portion. The present invention is able to avoid the pants crotch, and enables upwardly centrally fixing the position of the penis to prevent it from falling down to one side, thereby resolving the problems of ill health, unhygienic state and discomfort of the penis resulting from constant skin contact between the penis and the scrota, while at the same time effectively preventing the problem of compression deformation of the penis when an erection occurs when wearing tight-fitting pants.

13 Claims, 12 Drawing Sheets

POSITIONING STRUCTURE FOR THE MALE REPRODUCTIVE ORGAN

BACKGROUND OF THE INVENTION (a) Field of the Invention

The present invention relates to a positioning structure for the male reproductive organ, and more particularly to a positioning structure which contributes to the hygiene, health and comfort of the male reproductive organ, while at the same time is able to prevent the problem of compression deformation of the male reproductive organ (penis) when an erection occurs.

(b) Description of the Prior Art

Male underpants of the prior art or the development of related articles are still only able to provide functionality to cover the male private parts, and no real consideration has been given to the design of daily clothing articles that meets the needs of the general male population, and which adequately provides functionality to contribute to the comfort, hygiene and health of the male reproductive organ.

Referring to FIGS. 1, 2 and 3, wherein the male reproductive organ 90 is primarily composed of a penis 91, scrota 910 and the testicles (not shown in the drawings) enclosed within the scrota 910 tissue. A main body 1 of male underpants of the prior art, as depicted in FIG. 2, is only able to realize a general overall covering of the private areas of the buttocks and the lower private parts of the male body, thereby resulting in long time contact between the skin of the penis 91 and the scrota 910, which causes an unaerated state to occur. Accordingly, long time close contact between the skin of the different portions easily results in the propagation of bacteria because of the unaerated state and blocking of pore perspiration, as well as causing itching of the skin and other skin diseases; in particular, such phenomena easily occurs during the hot and humid summer weather or when perspiring after exercise. Furthermore, the current popular wearing of tight-fitting jeans or tight-fitting pants popularly results in the lower part of the body being unventilated, and is the main reason for further aggravation of the problems.

Apart from the aforementioned hygiene problems, according to related medical research disclosures, a considerable proportion of adult males have a flexural deformation problem of the penis, wherein the penis only suffers slight deformation when the problem is slight, however, those having serious deformation can even cause difficulty in marital sexual intercourse, and must seek a surgical procedure to rectify the problem. Investigations into the reason for such a problem have found that it primarily results from the customary wearing of tight-fitting jeans or tight-fitting pants for long periods of time, causing improper support for the compression of the reproductive organ when an erection occurs.

The primary composition of the penis 91 includes the corpus cavernosum and tunica albuginea tissues. When physiological or psychological factors cause hyperemia of the corpus cavernosum, then erection and expansion of the penis 91 naturally occurs, and size difference before and after erection differs from person to person, but is normally between twofold and threefold. In particular, when the male reaches puberty or the developmental phase, because of his vigorous and impulsive actions, as well as various factors, it is naturally easier for frequent erection of the penis 91 to occur. If a male customarily wears tight-fitting jeans or tight-fitting pants, when inevasible erection of the penis 91 occurs, then hyperemia and expansion of the corpus cavernosum and tunica albuginea tissues cause inertial pressure in the direction of the heterogeneous extension, thereby causing permanent flexural deformation 911. Because tight-fitting jeans or tight-fitting pants tightly cover the lower part of the male body, thus, a pants crotch 10 is usually tailored and fabricated relatively high, and does not retain appropriate spaciousness for movement of the male reproductive organ, Hence, the larger the erection of the penis 91, the easier it results in improper support for the compression, and the more apparent and seriousness of the degree of flexural deformation 911 is.

According to what has been described above, because the pants crotch 10 of tight-fitting jeans or tight-fitting pants is relatively high, thus, when the user is putting on such pants, the user must choose to keep the penis 91 away from the pants crotch 10, and place it either to the left side or the right side thereof. For those whose habit is to place the penis 91 on the left side of the pants crotch 10, then left-hand flexural deformation 911 of the penis 91 occurs, and for those whose habit is to place the penis 91 on the right side of the pants crotch 10, then right-hand flexural deformation 911 of the penis 91 occurs (as depicted in FIG. 1). Nevertheless, regardless of whether the user chooses to place his penis to the left side or the right side, limited by products of the prior art, users cannot avoid long-term downward inertia pressure of the penis 91, the result of which causes the occurrence of serious or slight downward flexural deformation 911. (as depicted in FIGS. 2 and 3).

In order to avoid the occurrence of flexural deformation 911 of the penis 91 because of inappropriate compression, and to prevent hygiene problems from long-term skin contact between the penis 91 and the scrota 910, an effective adaptive method suggested by medical practitioners is to as far as possible wear looser pants to maintain the health of the male reproductive organ 90. However, in a modern society that pursues faddish fashion, to convince the male populace to give up wearing tight-fitting jeans or tight-fitting pants that hinder the health of the reproductive organ is seemingly an unachievable goal. Furthermore, male underpants or related articles on sale in the current market have not developed a structural article that enables the penis 91 to avoid the pants crotch 10 and the occurrence of downward, leftward or rightward compression, while at the same time is convenient for the user to wear, and is capable of preventing long time skin contact between the penis 91 and the scrota 910.

In light of the above, it is the desire of the inventor and purpose of the present invention to resolve and improve the aforementioned shortcomings.

SUMMARY OF THE INVENTION

Accordingly, the present invention provides a positioning structure for the male reproductive organ, and uses a positioning structure to enable the penis to avoid the pants crotch, and upwardly centrally fix the position of the penis to prevent it from falling down to one side, thereby resolving the problems of ill health, unhygienic state and discomfort of the male reproductive organ resulting from constant skin contact between the penis and the scrota, while at the same time effectively preventing the problem of compression deformation of the penis when an erection occurs when wearing tight-fitting pants. Apart from resolving the aforementioned unhygienic state, discomfort and compression deformation of the penis, the present invention is further provided with effectiveness to facilitate putting on and use of the structure, as well as facilitating urination when in the toilet.

The first objective of the present invention is to provide the positioning structure for the male reproductive organ which primarily comprises a main body, a spacing portion, a holding portion and a positioning portion, wherein the main body further comprises at least one lower retaining portion and a waistband portion. The lower retaining portion covers the groin portion of the human body, and the waistband portion wraps around the waist of the human body. In addition, the holding portion comprises an entry end and an outlet opening end< When putting on the present invention, the two legs of the user are inserted through an inlet opening from an upper direction and respectively passed through outlet openings, then the user positions his reproductive organ relative to the entry end and places it within the holding portion. When the user needs to urinate, then he can take out his reproductive organ via the outlet opening end and urinate. Moreover, lines of stitches on two sides of the spacing portion are used to form a cylindrical shaped body of the holding portion provided with a hollow holding space, which enables the male reproductive organ to be laced therein. The positioning portion is located at the front portion of the waistband portion corresponding to the position of the holding portion when upwardly disposed, and the positioning portion is locally fixed to the waistband portion by stitching means. A gap retained by an unfixed portion in the middle of the positioning portion enables the holding portion to be disposed therein and fixedly positioned. In addition, elastic material is used to fabricate the positioning portion, including material such as binding elastic tape, thereby enabling the holding portion to be downwardly pressed to strengthen positioning functionality thereof.

The second objective of the present invention is to use a lower retaining portion having a long strip form that enables longitudinal covering of the groin portion of the human body from the lower region upwards, and comprises a front end portion and a rear end portion, which are respectively joined to the waistband portion, thereby forming the main body which enables the buttocks of the human body to be securely covered. At least one front annular ring is further defined on the front end portion, and one rear annular ring is defined on the rear end portion, thereby enabling the waistband portion to pass therethrough. The waistband portion comprises a right open end and a left open end, moreover, after the waistband portion has been threaded through the rear annular ring, then it is passed through the front annular rings, and overlaps on top of the front end portion to form the gap therebetween, thereby enabling the holding portion to be disposed into the gap. Furthermore, a male fixing member is located at the left open end corresponding to a female fixing member located at the right open end, thereby enabling length of the waistband portion to be adjusted therewith, and enabling the holding portion to be downwardly pressed at an appropriate position and fixedly positioned within the gap between the waistband portion and the front end portion by fastening together the male fixing member and the female fixing member, thereby providing positioning functionality.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
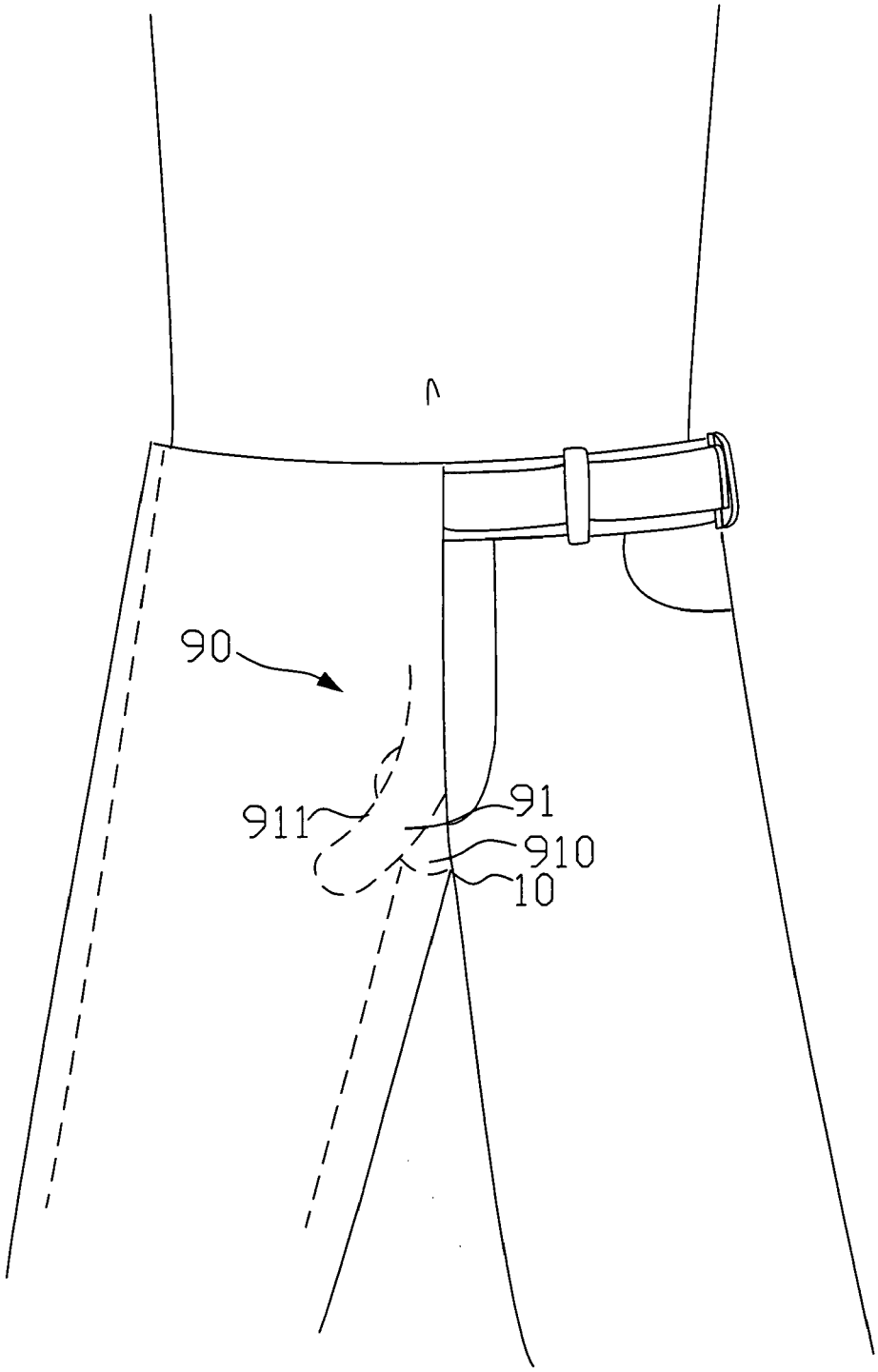
Fig. 1 Prior Art
FIG. 1 shows a front schematic view of a structure of the prior art and the male reproductive organ.
Figure 2:
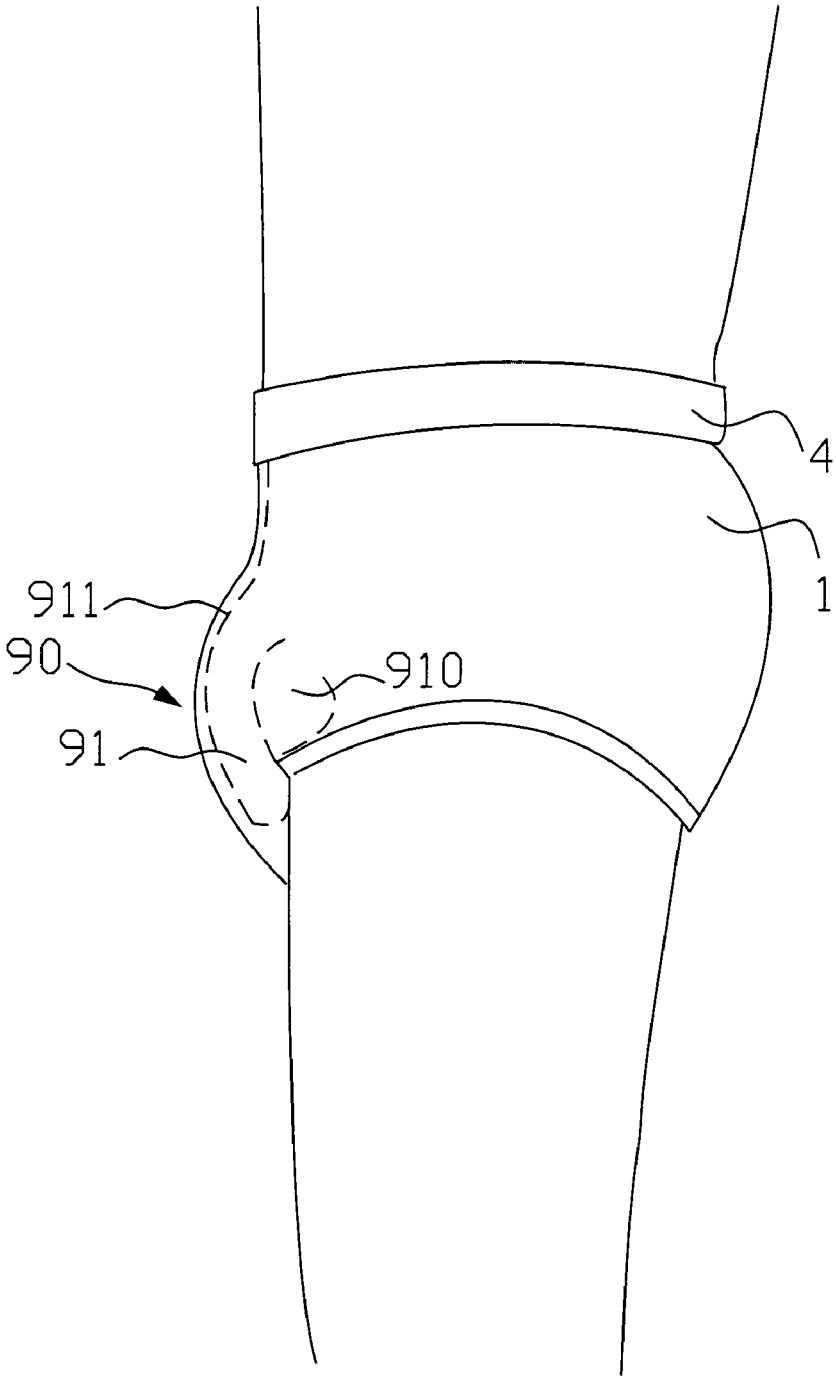
Fig. 2 Prior Art
FIG. 2 shows a side schematic view of the structure of the prior art and the male reproductive organ.
Figure 3:
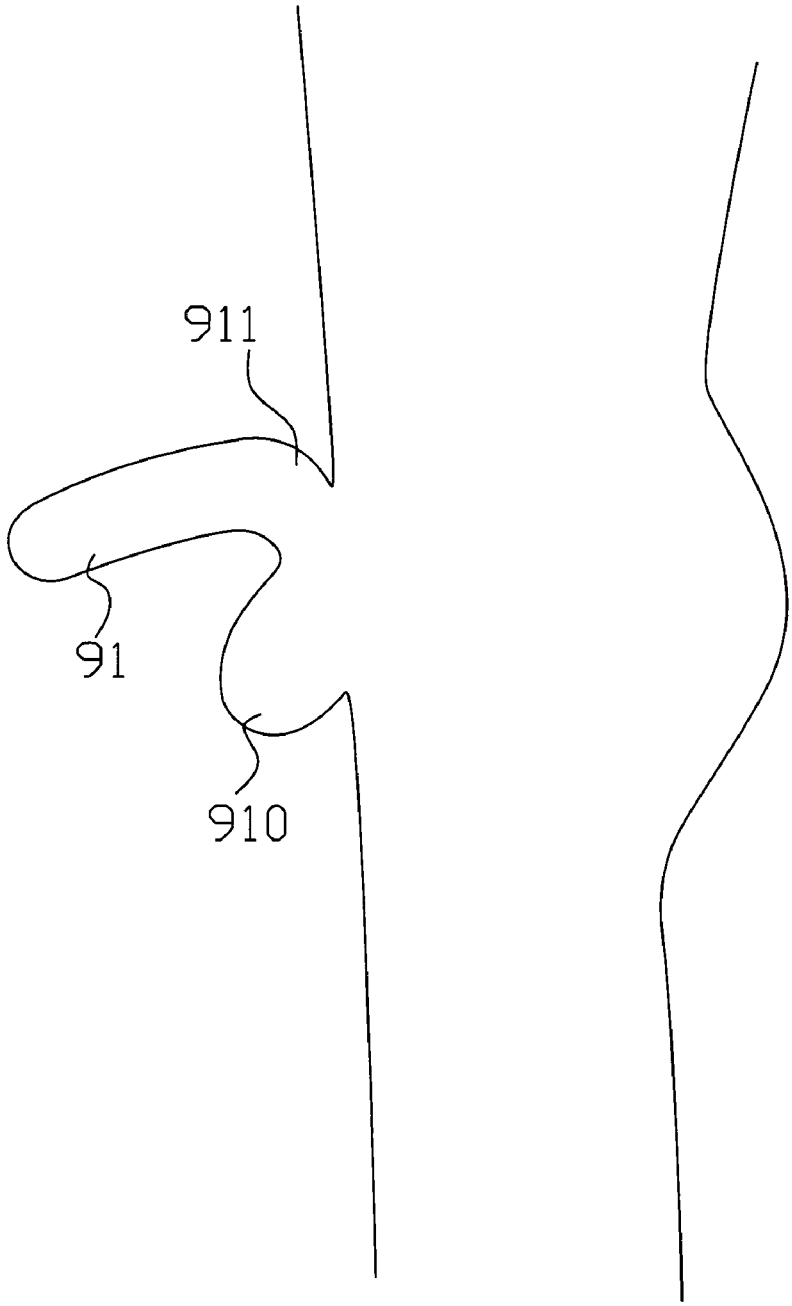
Fig. 3 Prior Art
FIG. 3 shows a side schematic view of the male reproductive organ.
Figure 4:
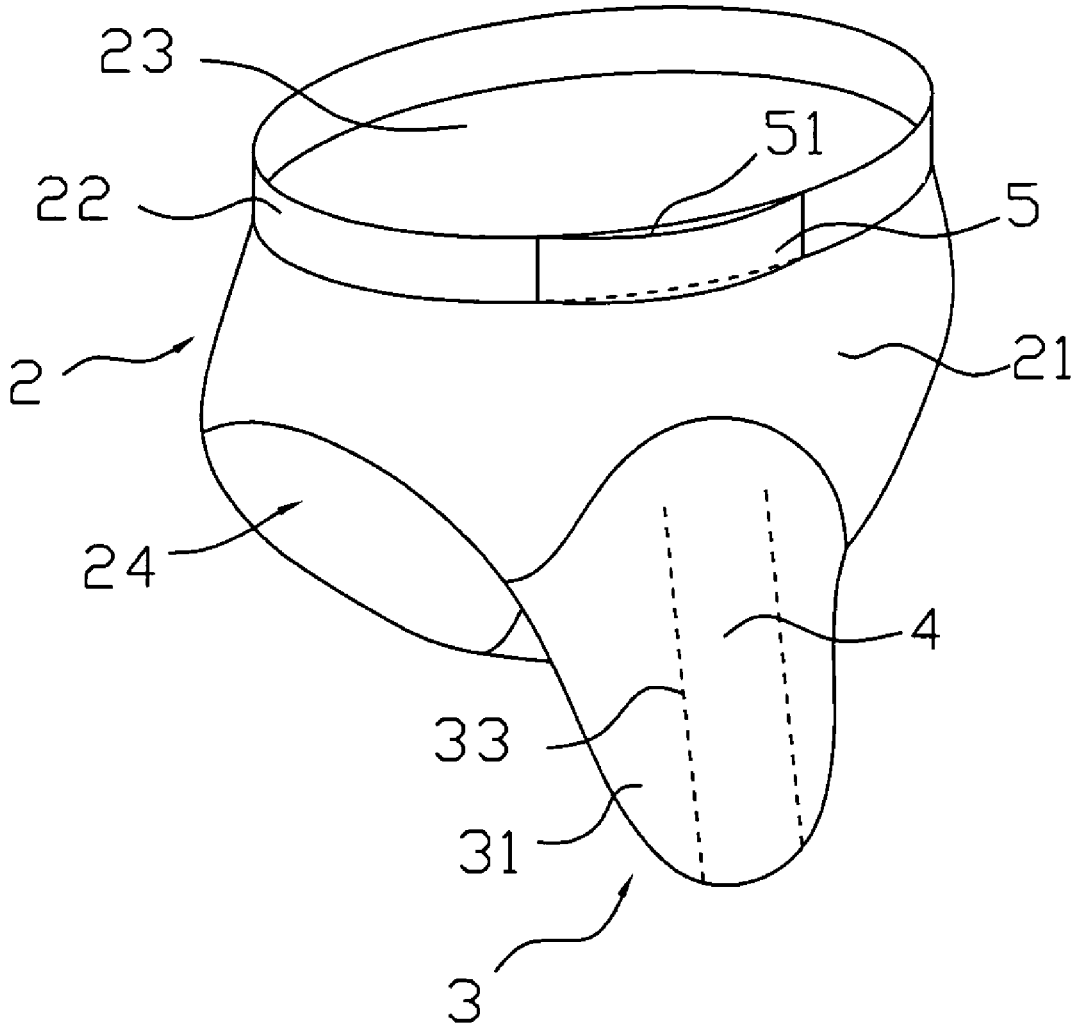
FIG. 4 shows a first front structural schematic view of a first embodiment according to the present invention.
Figure 5:
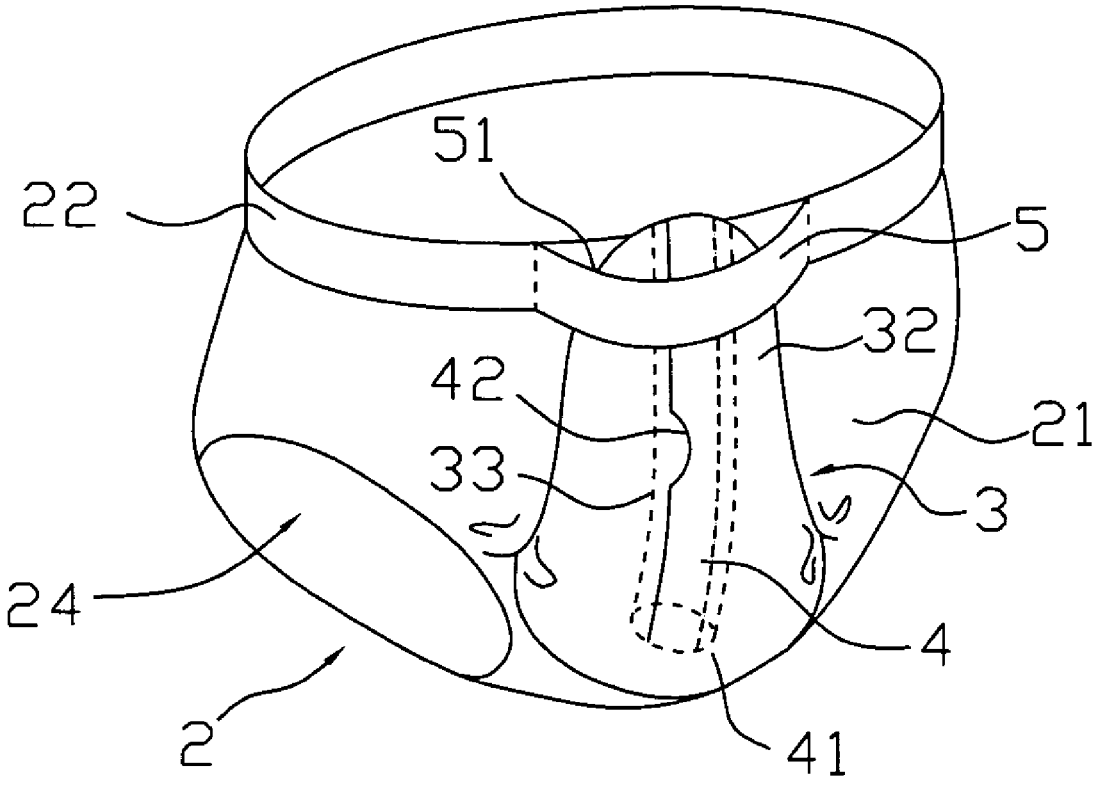
FIG. 5 shows a second front structural schematic view of the first embodiment according to the present invention.
Figure 6:
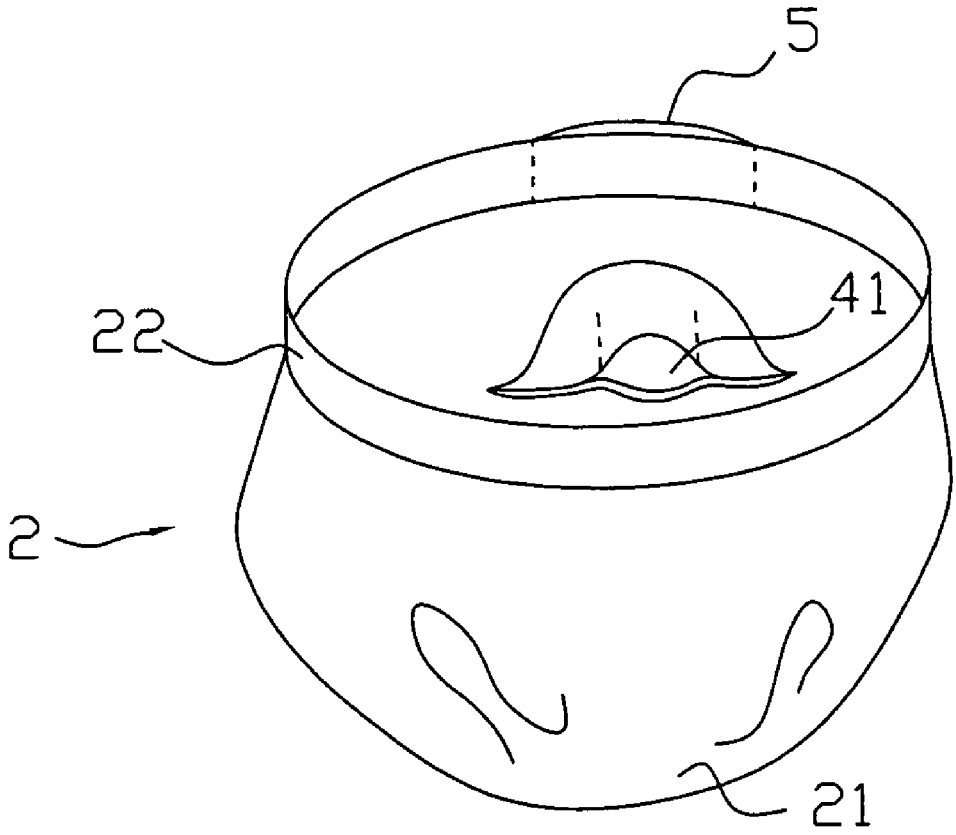
FIG. 6 shows a rear structural schematic view of the first embodiment according to the present invention.
Figure 7:
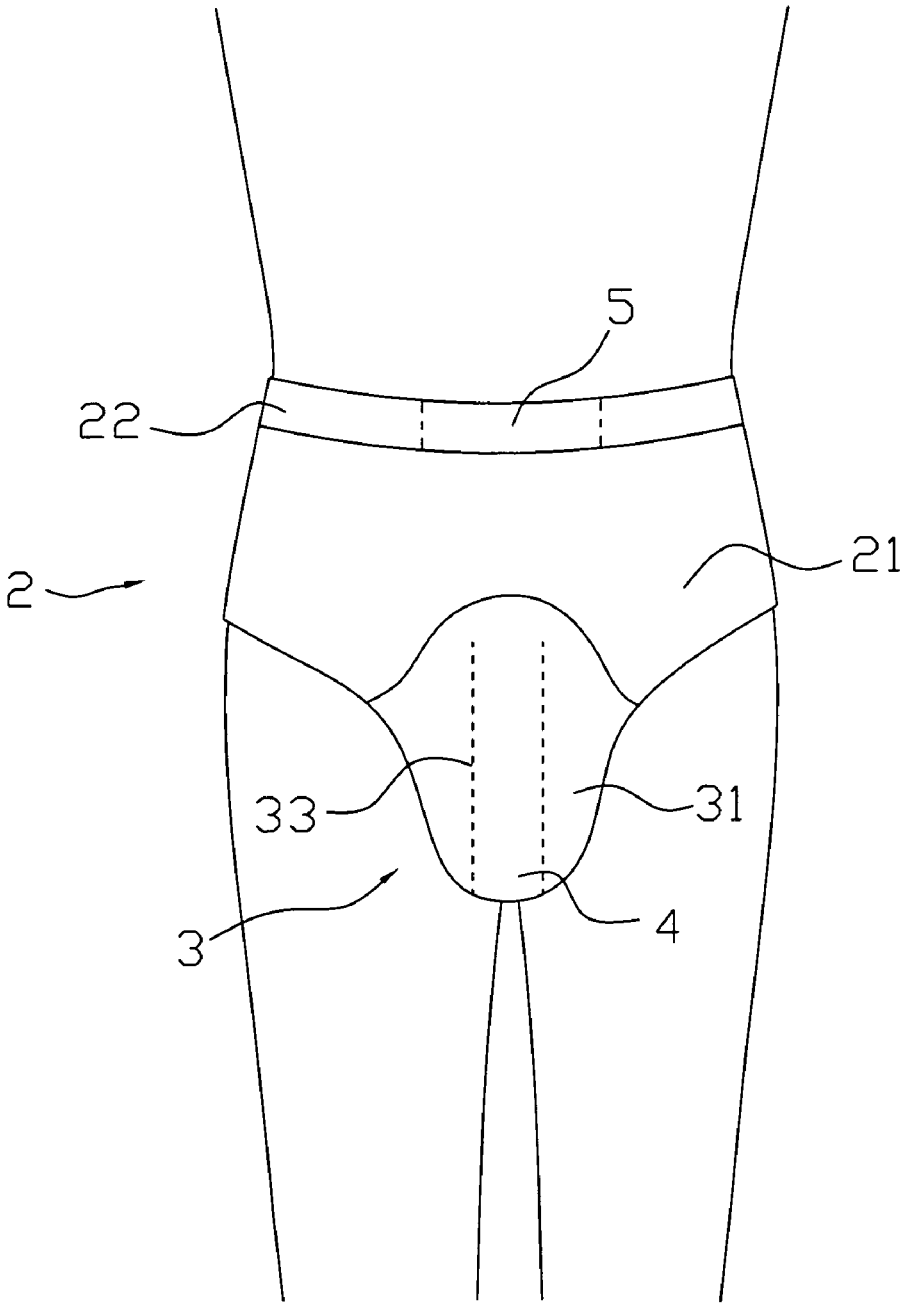
FIG. 7 shows a first structural schematic view of the first embodiment in use according to the present invention.
Figure 8:
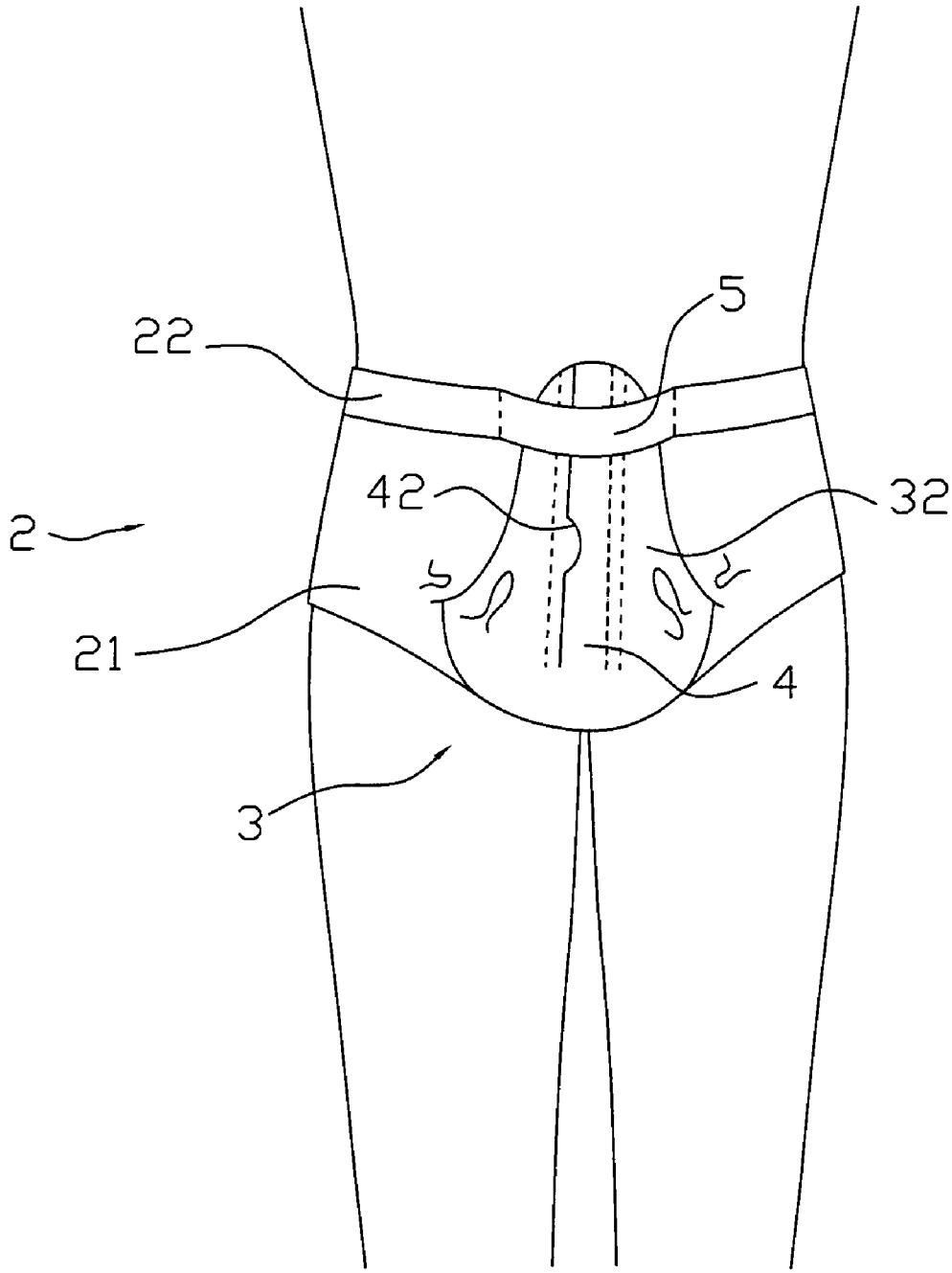
FIG. 8 shows a second structural schematic view of the first embodiment in use according to the present invention.

Referring to FIGS. 4, 5, 6, 7 and 8, which show a first embodiment of the present invention, which primarily comprises a main body 2, a spacing portion 3, a holding portion 4, and a positioning portion 5, wherein the main body 2 further comprises at least one lower retaining portion 21 and a waistband portion 22. The lower retaining portion 21 covers the groin portion of the human body, and the waistband portion 22 wraps around the waist of the human body. Moreover, fixed joining of the lower retaining portion 21 to the waistband portion 22 is used to enable the main body 2 to form an inlet opening 23 at an upper portion and outlet openings 24 at lower left and right portions, thereby enabling the two legs of the human body to be inserted through the inlet opening 23 from an upper direction and respectively passed through the outlet openings 24, and thus allowing the two legs to respectively extend downwardly from the outlet openings 24, as well as enabling the main body 2 to be moved upward to securely cover the buttocks of the human body.

The spacing portion 3 further comprises an upper strip member 31 and a lower strip member 32, which, after joining the upper strip member 31 and the lower strip member 32, enables covering the outside surface of the male reproductive organ, thereby achieving functionality to restrict movement of the male reproductive organ. Moreover, lines of stitches on two sides of the upper strip member 31 and the lower strip member 32 that make up the spacing portion 3 are used to form a cylindrical shaped body of the holding portion 4 provided with a hollow holding space. In addition, the holding portion 4 comprises an entry end 41 and an outlet opening end 42, wherein the entry end 41 is located at an end where the holding portion 4 is joined to the main body 2, and the outlet opening end 42 is located in the lower strip member 32. Referring again to FIGS. 5 and 6, when putting on the present invention, the two legs of the user are made to pass through the inlet opening 23 from an upper direction, after which the user positions his reproductive organ relative to the entry end 41 and places it within the holding portion 4. When the user needs to urinate, then he can take out his reproductive organ via the outlet opening end 42 and urinate.

Because a juxtaposed disposition is usually adopted as the configuration for the urinals in the male public toilet, thus, when urinating, the male reproductive organ of the urinating male in the adjacent urinal is easily seen, and the advantage of the outlet opening end 42 of the embodiment of the present invention formed in the lower strip member 32 lies in the upper strip member 31 of the spacing portion 3 covering on top of the male reproductive organ when the user is urinating, thus preventing others from seeing the reproductive organ of the user when urinating. However, during manufacture, the outlet opening end 42 can also be chosen to be formed in the upper strip member 31 or an opposite end (not shown in the drawings) of the holding portion 4 connected to the main body 2.

The positioning portion 5 assumes a strip form, and is located at the front portion of the waistband portion 22 corresponding to the position of the holding portion 4 when upwardly disposed, and the positioning portion 5 is locally fixed to the waistband portion 22 by stitching means. A gap 51 retained by an unfixed portion in the middle of the positioning portion 5 enables the holding portion 4 to be disposed therein and fixedly positioned. In addition, elastic material is used to fabricate the positioning portion 5, including material such as binding elastic tape, thereby enabling the holding portion 4 to be downwardly pressed to strengthen positioning functionality thereof.

Figure 9:
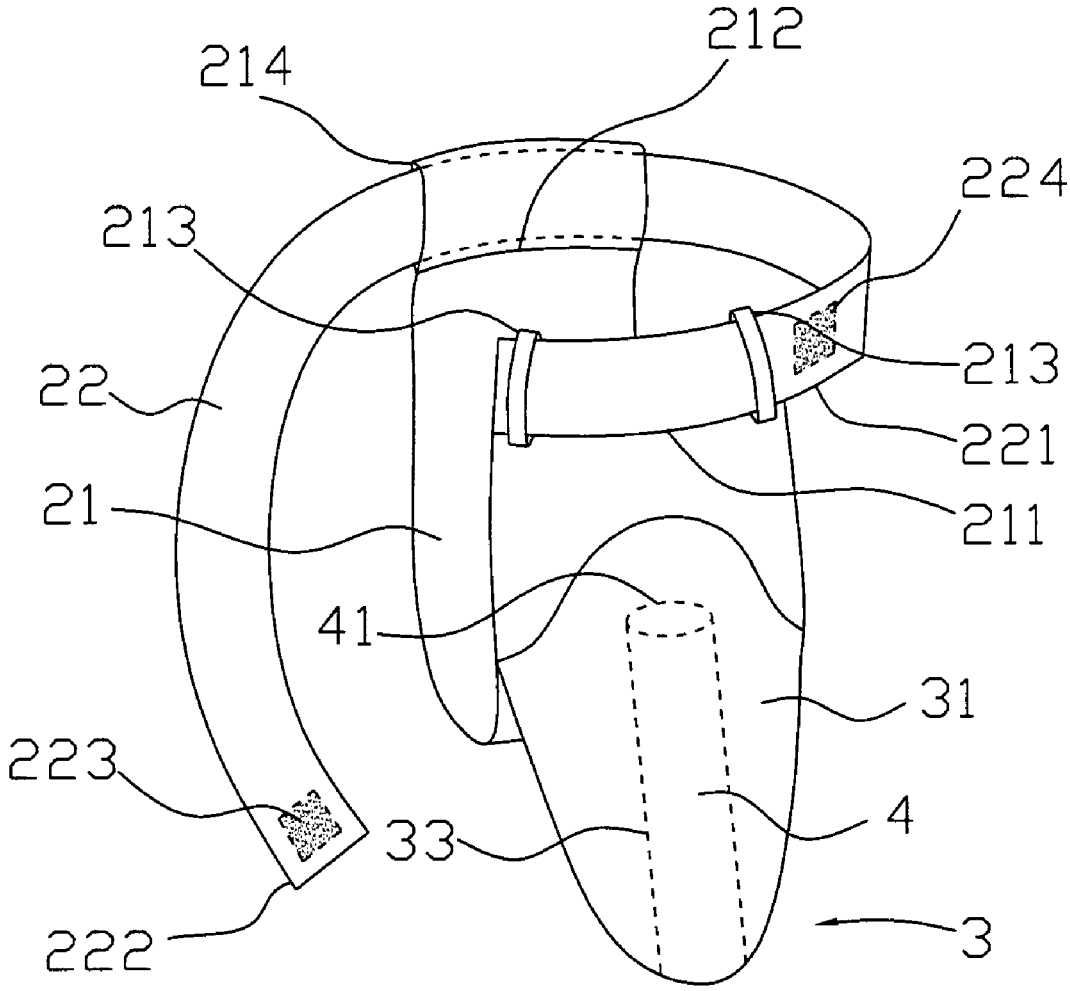
FIG. 9 shows a first front structural schematic view of a second embodiment according to the present invention.
Figure 10:
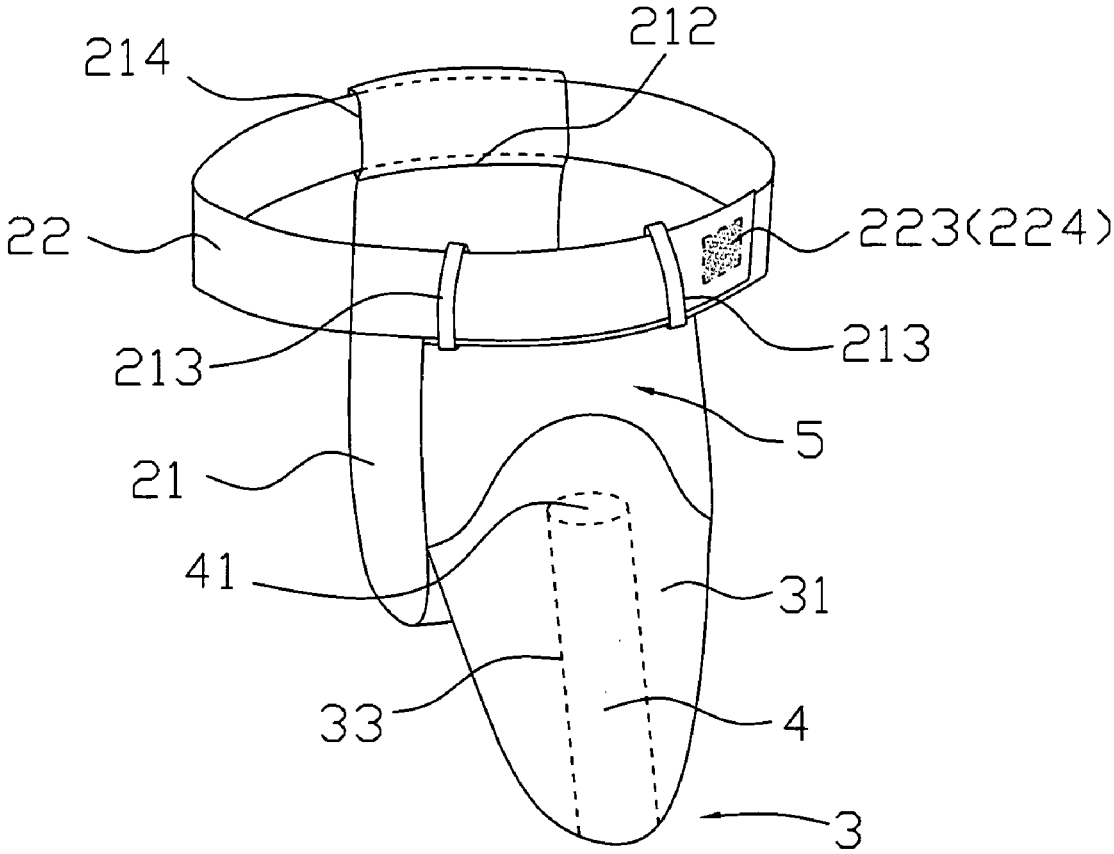
FIG. 10 shows a second front structural schematic view of the second embodiment according to the present invention.
Figure 11:
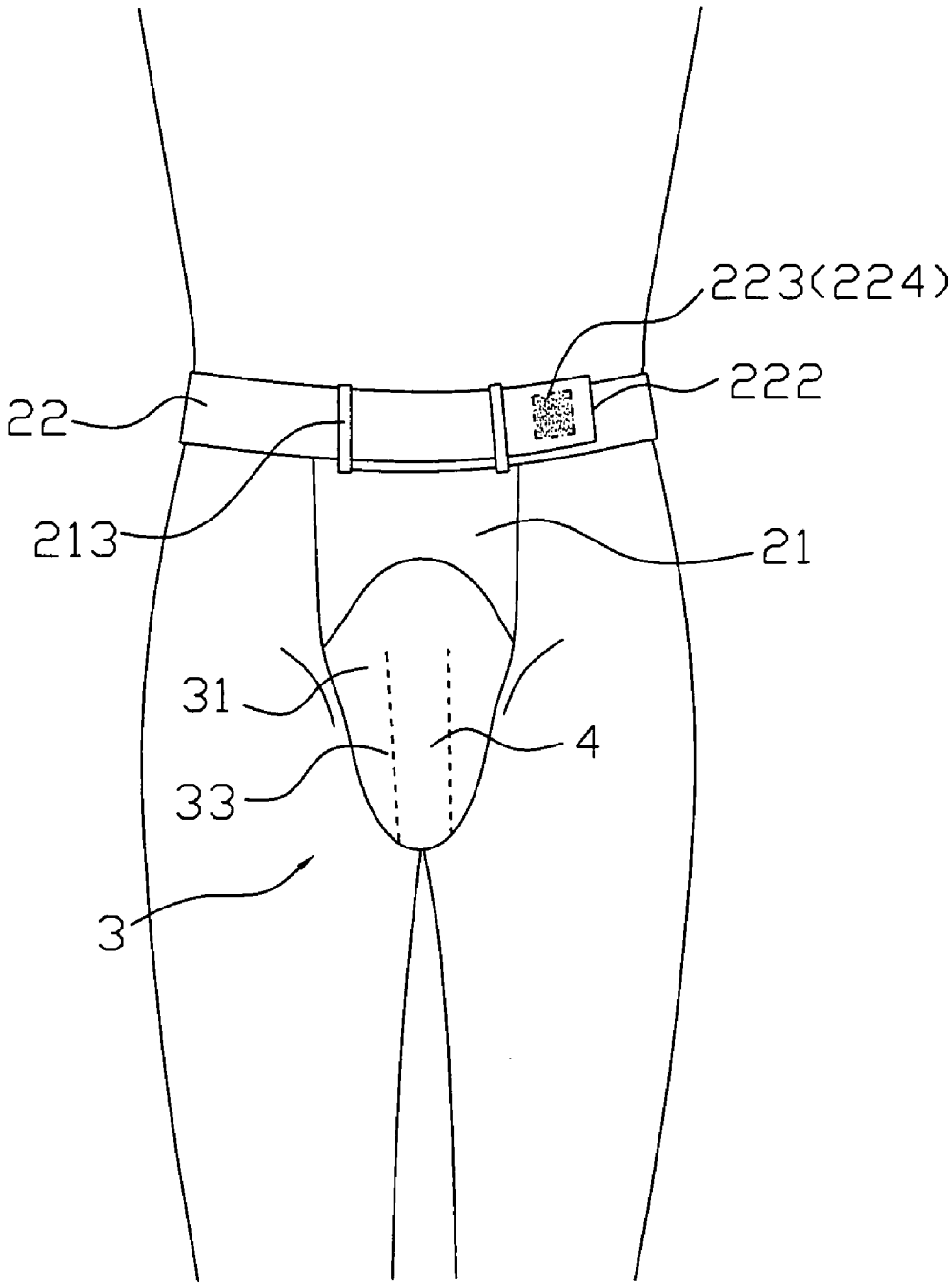
FIG. 11 shows a first structural schematic view of the second embodiment in use according to the present invention.
Figure 12:
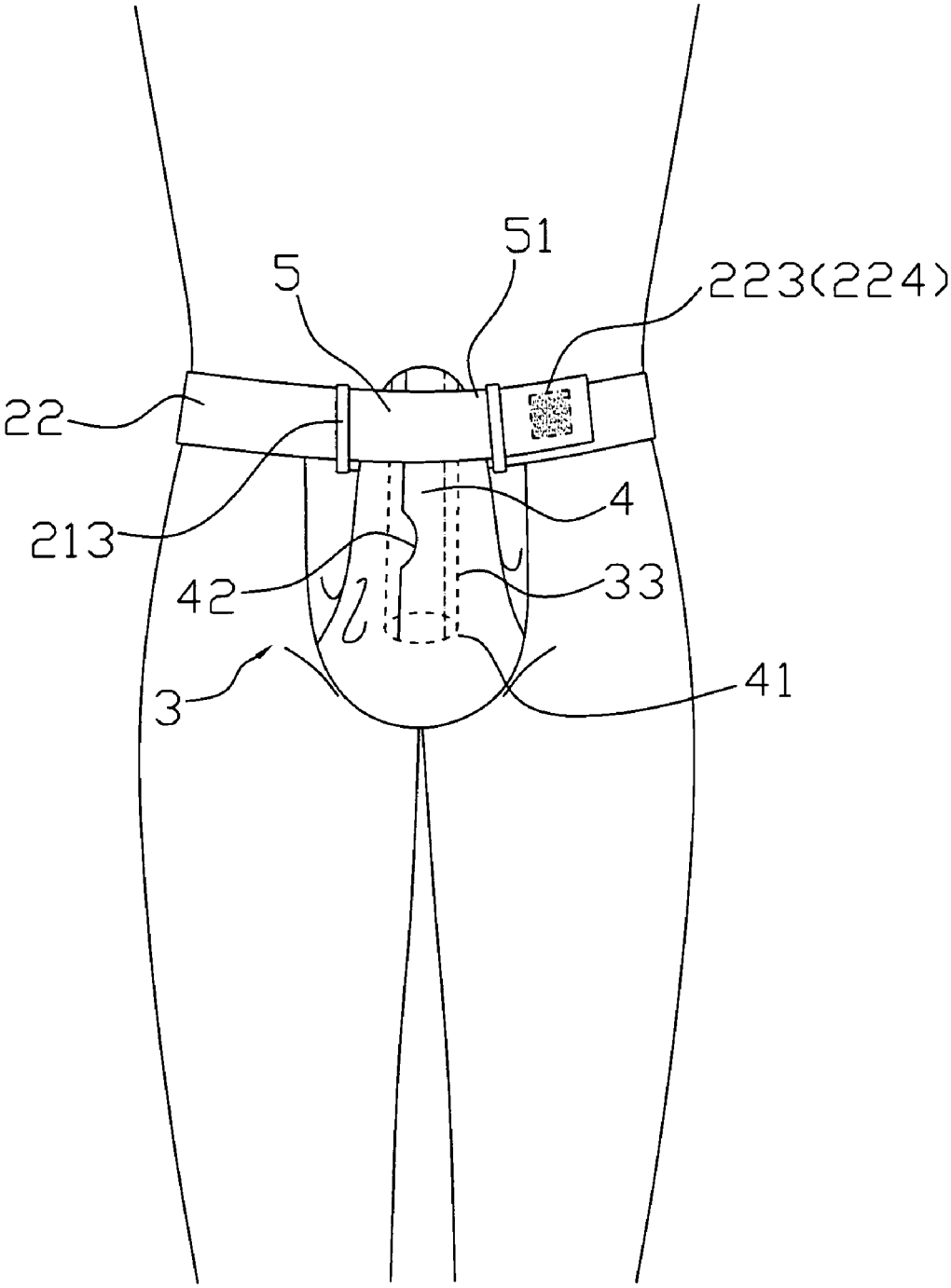
FIG. 12 shows a second structural schematic view of the second embodiment in use according to the present invention.

Referring to FIGS. 9, 10, 11 and 12, which show a second embodiment of the present invention, in which the embodiment primarily comprises the main body 2, the spacing portion 3, the holding portion 4 and the positioning portion 5, wherein the main body 2 further comprises the at least one lower retaining portion 21 and the waistband portion 22. The lower retaining portion 21 covers the groin portion of human body, and the waistband portion 22 wraps around the waist of the human body. The basic structures of the spacing portion 3 and the holding portion 4 of the second embodiment are the same as those described in the first embodiment; however, there are slight changes in the structures of the lower retaining portion 21, the waistband portion 22 and the positioning portion 5. The lower retaining portion 21 assumes a long strip form that enables longitudinal covering of the groin portion of the human body from the lower region upwards, and comprises a front end portion 211 and a rear end portion 212, which are respectively joined to the waistband portion 22, thereby forming the main body 2 which enables the buttocks of the human body to be securely covered.

At least one front annular ring 213 is further defined on the front end portion 211, and one rear annular ring 214 is defined on the rear end portion 212, thereby enabling the waistband portion 22 to pass therethrough. The waistband portion 22 comprises a right open end 221 and a left open end 222, moreover, after the waistband portion 22 has been threaded through the rear annular ring 214, then it is passed through the front annular rings 213, and overlaps on top of the front end portion 211 to form the gap 51 therebetween, thereby enabling the holding portion 4 to be disposed into the gap 51.

Furthermore, a male fixing member 223 is located at the left open end 222 corresponding to a female fixing member 224 located at the right open end 221, thereby enabling length of the waistband portion 22 to be adjusted therewith, and enabling the holding portion 4 to be downwardly pressed at an appropriate position and fixedly positioned within the gap 51 between the waistband portion 22 and the front end portion 211 (see FIG. 12) by fastening together the male fixing member 223 and the female fixing member 224. The gap 51 thus forms the positioning portion 5 which enables the holding portion 4 to be disposed and fixedly positioned therein.

When putting on the present invention, the user first separates the male fixing member 223 of the left open end 222 from the female fixing member 224 of the right open end 221, and then positions his reproductive organ relative to the entry end 41 and passes it through into the holding portion 4, after which the lower retaining portion 21 is used to longitudinally cover the groin portion of the human body from the lower region upwards. The left open end 222 is then passed through the rear annular ring 214 and the length of the waistband portion 22 movably adjusted to fit the waist of the user, after which the left open end 222 is passed through the front annular rings 213. and the holding portion 4 is upwardly disposed on the front end portion 211 of the lower retaining portion 21, the left open end 222 is then made to press down on top of the holding portion 4, after which the male fixing member 223 of the left open end 222 is adjusted relative to the female fixing member 224 of the right open end 221 to alter the degree of tightness of the waistband portion 22, and then the left open end 222 is fastened to the right open end 221. When the user wants to urinate, the spacing portion 3 together with the holding portion 4 is first lowered from the positioning portion 5, and the male reproductive organ is taken out from the outlet opening end 42 to urinate.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A positioning structure for the male reproductive organ, comprising:

a main body, the main body further comprises at least one lower retaining portion and a waistband portion, wherein the lower retaining portions cover the groin portion of the human body, and the waistband portion wraps around the waist of the human body; the main body uses the lower retaining portions and the waistband portion to securely cover the buttocks of the human body;

a spacing portion, the spacing portion further comprises an upper strip member and a lower strip member, which, after joining the upper strip member and the lower strip member, enables covering the outside surface of the male reproductive organ to achieve functionality to restrict movement of the male reproductive organ;

a holding portion, the holding portion assumes a cylindrical shaped body, and spacing functionality of the spacing portion is used to form a hollow holding space, thereby enabling the male reproductive organ to be placed therein;

a positioning portion, the positioning portion assumes a strip form, and is located at the front portion of the waistband portion corresponding to the position of the holding portion when upwardly disposed, and is used to enable the holding portion to be downwardly pressed and the position fixed thereof.

2. The positioning structure for the male reproductive organ according to claim 1, wherein fixed joining of the lower retaining portions to the waistband portion is used to enable the main body to form an inlet opening at an upper portion and outlet openings at lower left and right portions, thereby enabling the two legs of the human body to be inserted through the inlet opening from an upper direction and respectively passed through the outlet openings, and thus allowing the two legs to respectively extend downwardly from the outlet openings, as well as enabling the main body to be moved upward to securely cover the buttocks of the human body.

3. The positioning structure for the male reproductive organ according to claim 1, wherein lines of stitches on two sides of the upper strip member and the lower strip member that make up the spacing portion are used to form a cylindrical shaped body of the holding portion.

4. The positioning structure for the male reproductive organ according to claim 1, wherein the holding portion comprises an entry end and an outlet opening end.

5. The positioning structure for the male reproductive organ according to claim 4, wherein the entry end is located at an end where the holding portion is joined to the main body, and the outlet opening end is located in the lower strip member.

6. The positioning structure for the male reproductive organ according to claim 4, wherein the entry end is located at the end where the holding portion is joined to the main body, and the outlet opening end is located in the upper strip member.

7. The positioning structure for the male reproductive organ according to claim 4, wherein the entry end is located at the end where the holding portion is joined to the main body, and the outlet opening end is located at the opposite end to where the holding portion is joined to the main body.

8. The positioning structure for the male reproductive organ according to claim 1, wherein two sides of the positioning portion are locally fixed to the waistband portion by stitching means, and a gap retained by the middle of the positioning portion enables the holding portion to be disposed therein and fixedly positioned.

9. The positioning structure for the male reproductive organ according to claim 1, wherein the positioning portion is fabricated from elastic material to strengthen positioning functionality thereof.

10. The positioning structure for the male reproductive organ according to claim 1, wherein the lower retaining portion assumes a long strip forms that enable longitudinal covering of the groin portion of the human body from the lower region upwards, and two ends of the retaining portion are respectively joined to the waistband portion, thereby enabling the main body to securely cover the buttocks of the human body.

11. The positioning structure for the male reproductive organ according to claim 10, wherein the lower retaining portion comprises a front end portion and a rear end portion; at least one annular ring is located on the front end portion, and one annular ring is located on the rear end portion, thereby enabling the waistband portion to pass therethrough.

12. The positioning structure for the male reproductive organ according to claim 11, wherein the waistband portion is first passed through the rear annular ring, and then passed through the front annular rings, thereby forming a gap between the lower retaining portion and the front end portion; the gap enables the holding portion to be disposed therein.

13. The positioning structure for the male reproductive organ according to claim 11, wherein the waistband portion comprises a left open end and a right open end; a male fixing member is located at the left open end, and a female fixing member is located at the right open end; the male fixing member and the female fixing member are used to adjust the length of the waistband portion and enable the left open end and the right open to be fastened together.

* * * * *